US006712264B2

(12) United States Patent
Bromberg

(10) Patent No.: US 6,712,264 B2
(45) **Date of Patent: *Mar. 30, 2004**

(54) WHEEL CALCULATOR

(76) Inventor: Ronald Bromberg, 2675 Henry Hudson Pkwy., Bronx, NY (US) 10463

( * ) Notice: Subject to any disclaimer, the term of this patent is extended or adjusted under 35 U.S.C. 154(b) by 0 days.

This patent is subject to a terminal disclaimer.

(21) Appl. No.: 10/201,618

(22) Filed: Jul. 22, 2002

(65) Prior Publication Data

US 2003/0024974 A1 Feb. 6, 2003

Related U.S. Application Data

(63) Continuation-in-part of application No. 09/364,428, filed on Jul. 30, 1999, now Pat. No. 6,460,762.

(51) Int. Cl.[7] ..... G06C 27/00
(52) U.S. Cl. ..... 235/78 R; 235/77
(58) Field of Search ..... 235/78 R, 77, 235/487, 491, 493, 495; 369/281; 360/98.08, 99.12

(56) References Cited

U.S. PATENT DOCUMENTS

| | | | | | |
|---|---|---|---|---|---|
| 3,778,766 | A | * | 12/1973 | Rapp | 714/807 |
| 3,862,398 | A | * | 1/1975 | Toscan | 235/61 NV |
| 4,680,453 | A | * | 7/1987 | Pugh | 235/88 R |
| 4,754,125 | A | * | 6/1988 | Penn | 235/88 R |
| 5,374,461 | A | * | 12/1994 | Bromberg | 428/43 |
| 5,470,627 | A | * | 11/1995 | Lee et al. | 428/64.4 |
| 5,678,862 | A | * | 10/1997 | Hughes et al. | 283/65 |
| 5,875,171 | A | * | 2/1999 | Albrecht et al. | 369/281 |
| 6,460,762 | B1 | * | 10/2002 | Bromberg et al. | 235/78 R |

* cited by examiner

*Primary Examiner*—Karl D. Frech
(74) *Attorney, Agent, or Firm*—Herbert Dubno

(57) ABSTRACT

A wheel chart having at least one rigid disk formed by a compact disk which, in addition to having a mirrored or reflective layer capable of carrying reproducible information, has legible matter on an obverse side which cooperates with a member such as a transparent rigid disk which can also bear indicia to enable calculations to be made by relative rotation of a disk and a member juxtaposed therewith.

15 Claims, 8 Drawing Sheets

FIG.8
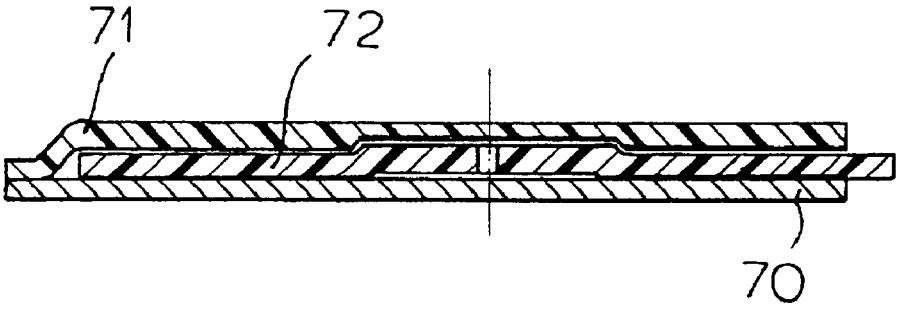
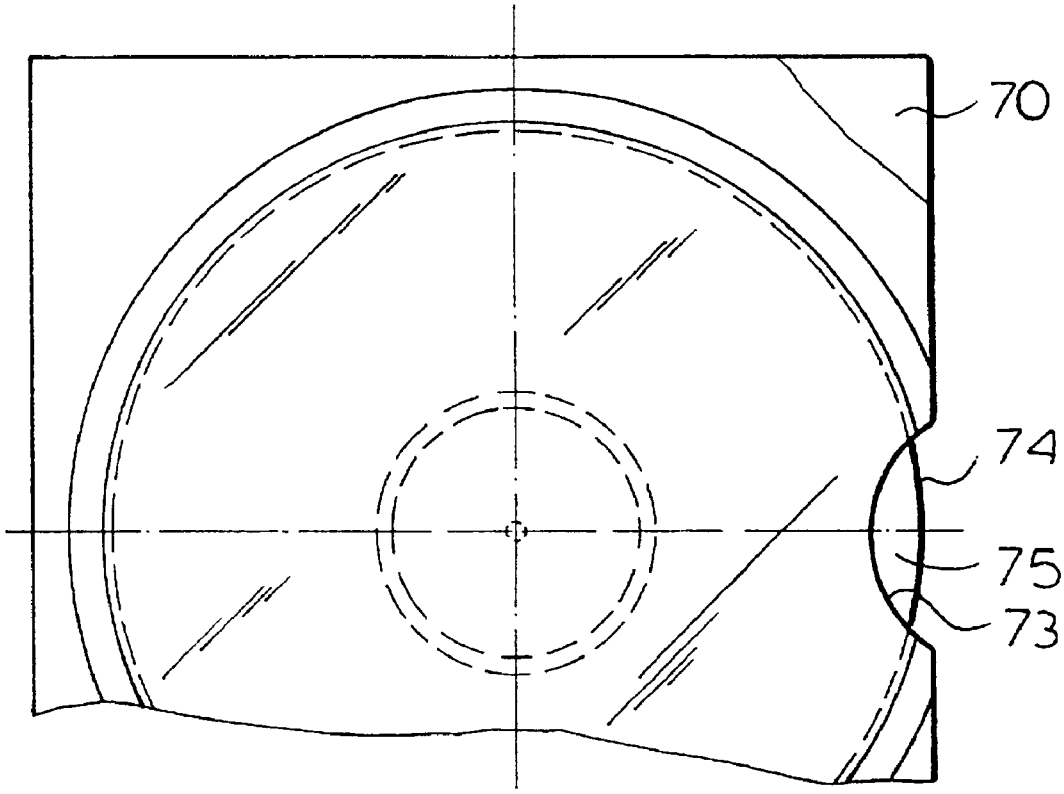
FIG.9

WHEEL CALCULATOR

CROSS REFERENCE TO RELATED APPLICATIONS

This application is a continuation-in-part of Ser. No. 09/364,428 filed Jul. 30, 1999, now U.S. Pat. No. 6,460,762.

FIELD OF THE INVENTION

The present invention relates to a wheel calculator and, more particularly, to a wheel calculator in which at least one of the relatively rotatable members is a compact disk or at least the circular body or blank of a compact disk.

BACKGROUND OF THE INVENTION

Wheel calculators have been provided heretofore in a wide variety of configurations and for many different purposes. For example, a circular slide rule may combine a disk with a cursor on a member rotatable relative to the disk and circular slide rules may have several disks, a window arrangement and various index markings enabling calculations to be made based upon indicia on the disks or the relatively rotatable members. Less sophisticated wheel calculators may include an information carrying wheel rotatable beneath or between other disk shaped members or cover structures which may be provided with windows or clear areas or openings through which information on the disk can be read. Wheel calculators may be used to forecast events, as calendars, as calculators for taxes, fees, rebates or the like, and as devices facilitating the selection of a particular condition. They may be free to hold in the hand, or permanently affixed into, say, a book, and may be themselves promotional materials or may be incorporated in promotional materials. In practically all cases in which a wheel has been a rigid member in earlier systems, that wheel was specifically designed for the calculator, generally had a considerable thickness, and was especially fabricated and hence of comparatively high cost.

Where the wheel was composed of a nonrigid material, e.g. paper or cardboard, it could be effectively die cut from a web or sheet of such material and provided with a central perforation or die cut to accommodate the member forming a journal for that wheel, i.e. a member enabling rotation of the wheel relative to something else.

Flexible wheels of this type were prone to damage and were easily distorted not only by misuse but even in regular or careful use.

OBJECTS OF THE INVENTION

It is the principal object of the present invention to provide an improved wheel calculator which avoids drawbacks of earlier wheel calculators.

Another object of this invention is to provide a wheel calculator less prone to damage then earlier wheel calculators, which is inexpensive to manufacture and is both aesthetically pleasing and satisfying to use.

SUMMARY OF THE INVENTION

These objects and others which will become apparent hereinafter are attained, in accordance with the invention, in a wheel calculator, wheel chart or wheel display device comprising at least one disk, at least one member cooperating with the disk and enabling information carried by the disk to be indexed or displayed and means for mounting the disk and member so that they are relatively rotatable about an axis of the disk whereby different information on the disk can register with the member. According to the invention, the disk is a compact disk or CD-ROM or DVD or a disk body or blank free from data, information, music or images, and the journal between the member and the compact disk is formed by the conventional hole provided in the compact disk.

When reference is made herein to a compact disk body, I intend thereby to describe a circular disk which generally has a diameter of less than 15 cm and preferably at most 12 cm with a hub portion generally of a diameter less than 4 cm and preferably of approximately 3.5 cm with a circular hole which can be of a diameter of less than 2 cm and preferably about 1.8 cm, formed unitarily of a transparent resin material. To at least one surface of this body or blank a mirror coating (metallization) is customarily applied around the hub so that a compact disk is formed.

The compact disk can carry digital information beyond the legible information imprinted thereon and with which the member cooperates. For example, the compact disk may be a CD-ROM, a compact disk containing musical selections or audio information and readable in the disk reader of a computer or adapted to be played in a CD player. It can carry visually reproducible information, for example, sequences of still photographs, motion pictures and the like. In the broadest case, however, the only information required to be on that compact disk is the legible information which is selected by the aforementioned member.

According to another feature of the invention that other member is, in turn, a rigid disk having at least a portion through which information on the first mentioned compact disk is visible.

In a preferred embodiment, the rigid disk is a synthetic resin transparent disk, similar to that of a compact disk, but not provided with the mirror-like information carrier coating of the compact disk, i.e. a disk body or blank. Legible matter can be imprinted on the transparent disk and advantageously, that legible matter can extend around the periphery of the transparent disk. The hubs and holes of the two disks may be interconnected by the means enabling relative rotation of the two disks. The transparent disk is, of course, then provided on top of the compact disk which may be imprinted with promotional information, source information, instructive information on the surface outwardly of the hub but opposite the rear mirrored surface of the compact disk, thereby allowing such information to be visible through the transparent disk.

According to a feature of the invention, the rigid disk, which can have a configuration of a compact disk with a central hole, a hub surrounding this hole and a region between the hub and the periphery which is at least partly metallized on, received in or engaged by a support so that it is centered by its inner or outer periphery to enable rotation of the disk relative to the support. The support and the disk are provided with correlatable indicia so that, upon rotation of the disk, indicia on the disk can be lined up with indicia on the support. The indicia may be printed on the respective services or may be formations, for example, windows, notches or other formations in the support. When indicia on the support are to be viewed through a transparent portion of the disk, the disk will only be partially metallized in the aforementioned area. When the indicia on a surface of the disk which does not require viewing through a transparent region, then the disk may be fully metallized.

Advantageously, the support can be formed with a pocket receiving the disk and the disk can have an edge exposed by the support to enable rotation of the disk. The support may be a paperboard envelope or folder, a paperboard or other backing material provided with a blister of a plastic material overlying the disk, or a plastic envelope or folder. In general, the disk can be received between the leaves or sheets or surfaces of the envelope, one or both of which may bear the indicia of the support.

Mention has already been made of the fact that either the inner or outer periphery of the disk can be used to guide the disk on the support and the support can have a cavity in which the disk is deposited for outer peripheral guides.

BRIEF DESCRIPTION OF THE DRAWING

The above and other objects, features, and advantages will become more readily apparent from the following description, reference being made to the accompanying drawing in which:

FIG. 8 is a cross sectional view through a blister cover for the disk in still a further embodiment;

FIG. 9 is a fragmentary elevational view of yet another embodiment of the invention of which FIG. 8 is a section.

SPECIFIC DESCRIPTION

Figure 1:
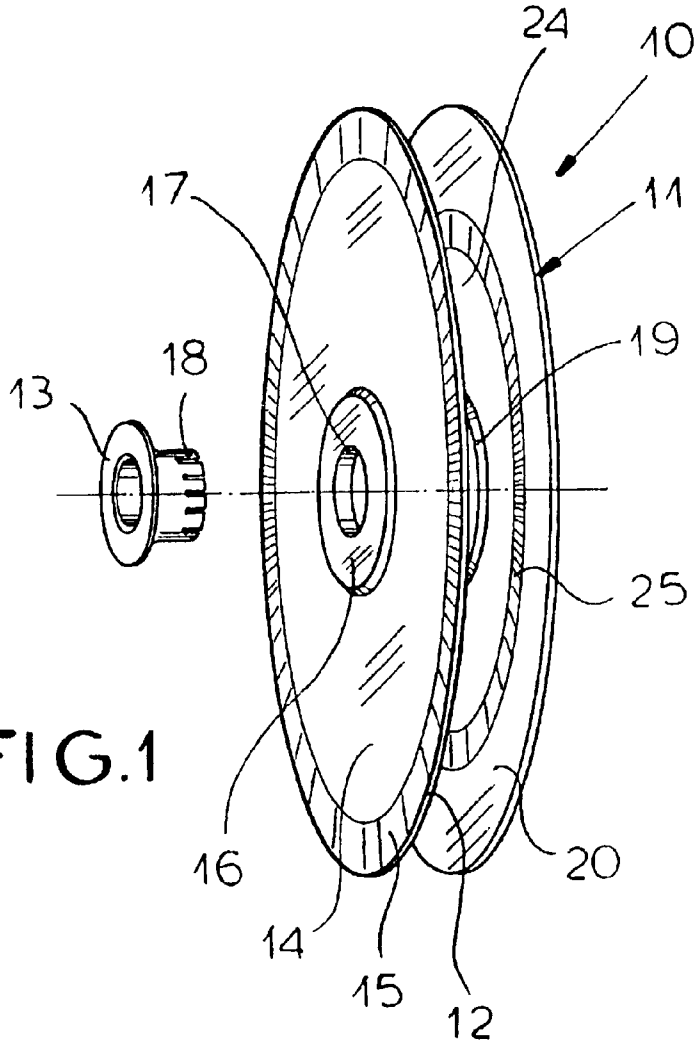
FIG. 1 is an exploded perspective view of a wheel chart illustrating the present invention.

From FIG. 1, it will be apparent that a wheel chart 10 based upon a compact disk 11 can have a transparent disk 12 affixed to the compact disk 11 by a holder 13 enabling relative rotation of the two disks.

The transparent disk 12 is a plastic disk identical to the plastic disk from which the compact disk 11 is made, but without the mirror surface which forms the audio, electronic or optical data carrier of the compact disk.

On the obverse surface 14 of the disk 12, which is transparent, there may be printed indicia 15 allowing the two disks to be used as a wheel chart by rotating the disks relatively and reading information from the two disks and through the transparent disk from the underlying compact disk.

Figure 5:
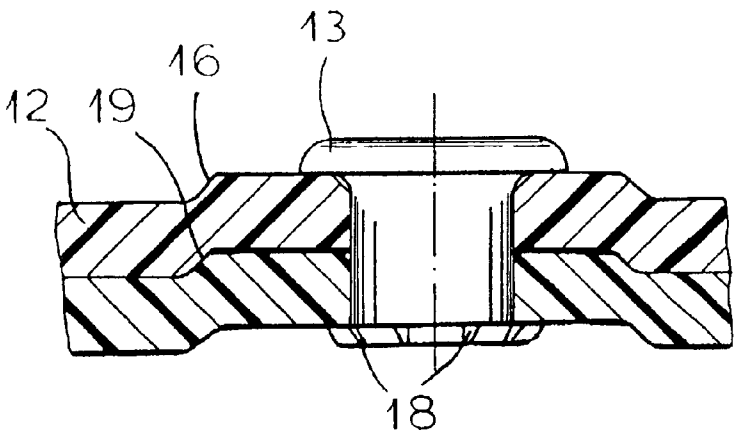
FIG. 5 is an assembled detail of the wheel chart according to the invention.
Figure 4:
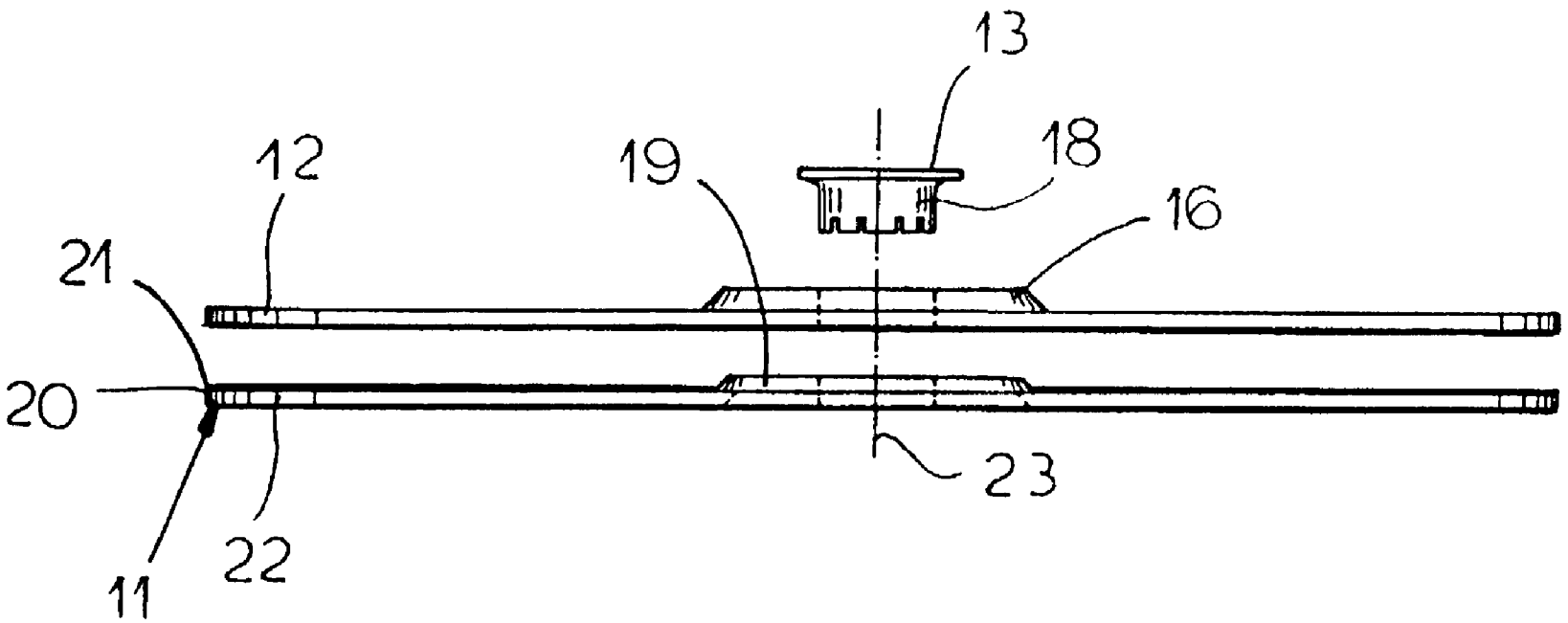
FIG. 4 is an exploded side view of the wheel chart.

The transparent disk has a raised hub portion 16 which also can be seen better in FIGS. 4 and 5. A hole 17 at the center of the hub portion, receives fingers 18 of the holder 13 which can be biased inwardly when the holder is thrust into the hole 17, the tips of the fingers engaging behind the hub portion 19 of the compact disk. The compact disk in turn has on its obverse 20, a layer 21 which is reflective and is the electronic, optical and audio recording layer, the underside of which is exposed through the transparent body of the contact disk from its reverse side 22. The compact disk 11 also has a hole 23 through which the fingers 18 pass and which is coaxial with the hole 17 of the plastic cover disk 12.

As can be seen from FIG. 1, the compact disk 11 is opaque and can be imprinted in a central zone 24 with descriptive matter, promotional matter or identifying matter. Outwardly of this central area, it can be provided with other indicia 25 cooperating with the indicia 15 to allow event calculations and the like.

Figure 2:
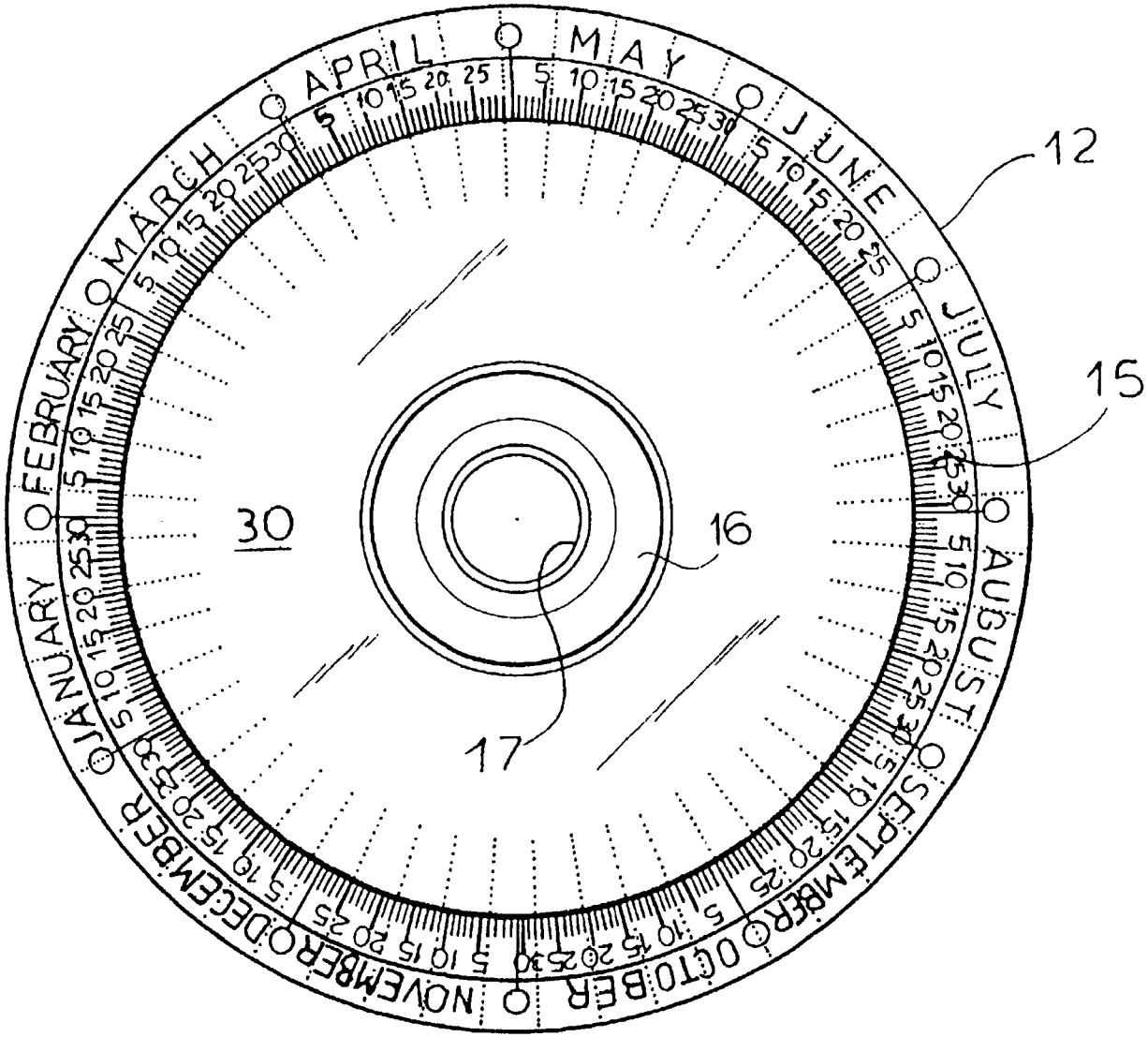
FIG. 2 is a plan view of the transparent disk of that wheel chart.
Figure 3:
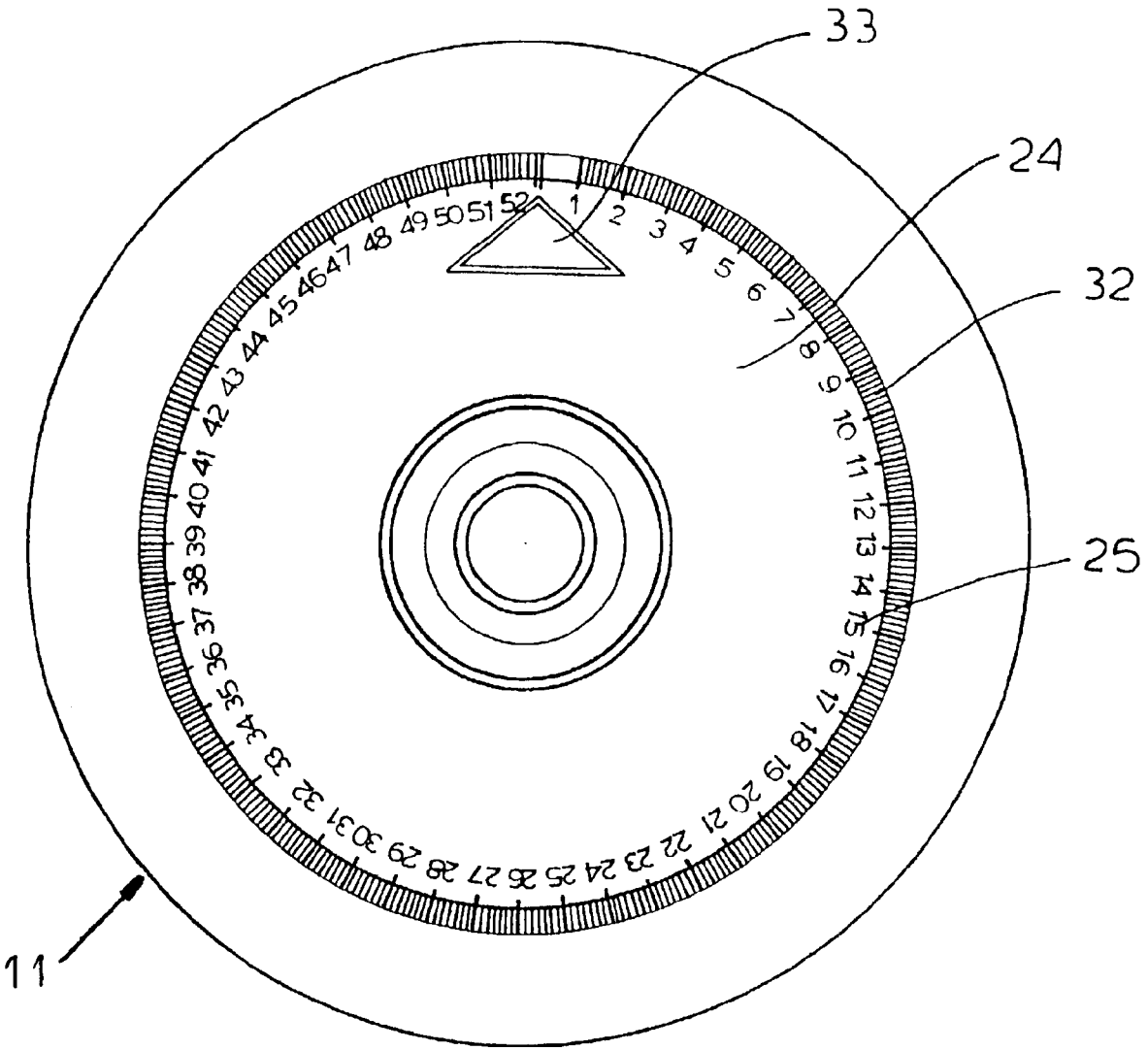
FIG. 3 is a plan view of the compact disk thereof.

For example, the transparent disk 12 as seen in FIG. 2, has the hole 17 and the raised hub portion 16 but is transparent throughout the body of that disk with a zone with a region 30 between the hub 16 and the indicia zone 31 which is completely free from any markings and through which the printed region 24, 25 of the compact disk 11 is visible (compare FIGS. 2 and 3).

In the embodiment shown, which is a delivery date calculator, the number of weeks can be provided on a scale 32 at the boundary of the region 24 and along the scale 25. An arrowhead or printer can be provided at 33. The arrowhead and the scale 32 are visible behind the disk 12 which has, as the scale 15, date markings for each month and a display of the months (FIG. 2).

When the device is assembled so that two disks can be rotated relatively, delivery dates can be calculated. If desired, the device can be pulled apart to allow the compact disk to be played.

Figure 6:
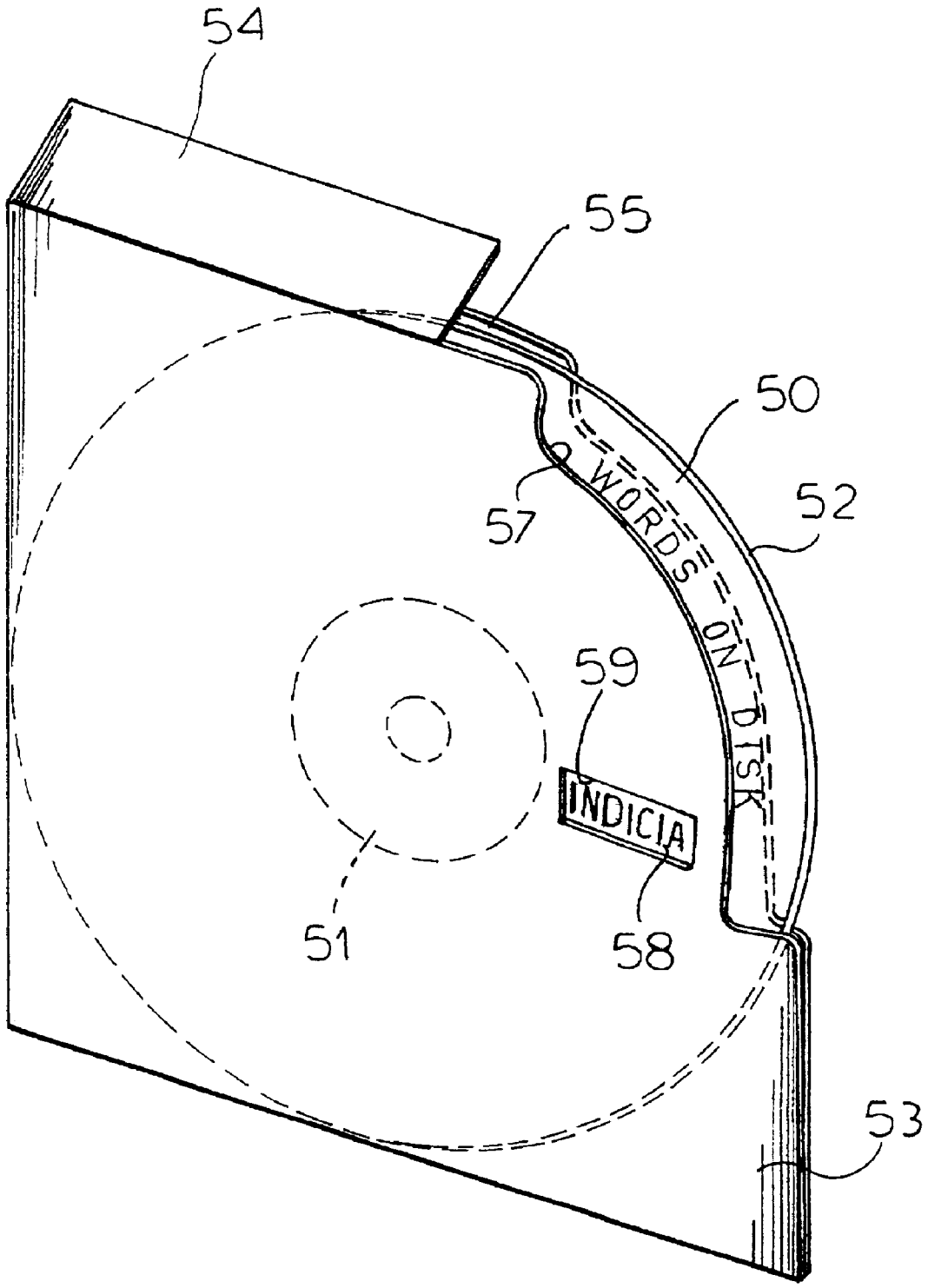
FIG. 6 is a diagrammatic illustration of another embodiment of the invention.

FIG. 6 shows an arrangement in which rigid disk 50, which is partly or fully metallized in the region between the hub portion 51 and the outer periphery 52 is received in a support 53 formed as a paperboard envelope which can be originally sealed by a flap 54 at an open side 55. When the flap is released, the disk 50 can be removed and any machine readable indicia which is borne by the metallization can be played on a compact disk player. The disk may have indicia 56 which can be visible through a notch or cut out portion 57 of the envelope as well as indicia 58 inwardly of the periphery which can be viewed through one or more windows 59 in the envelope. In this case, the windows form indicia as well and the support can have one or both surfaces printed.

In practice, the peripheral edge 52 is exposed in the cut out region 57 to enable it to be gripped by the user and the wheel chart utilized to provide the information for which the indicia on the disk and the support are correlated. When the flap 54 is opened, the disk can be removed and played like a conventional CD.

In that case, the CD is contained by and can be spun or rotated in a pocket and the CD is gripped by its outer periphery and is guided in rotation by its outer periphery. The CD can be also utilized in a computer.

Additional flaps can be provided on the envelope and can be imprinted with information or advertisements.

Figure 7:
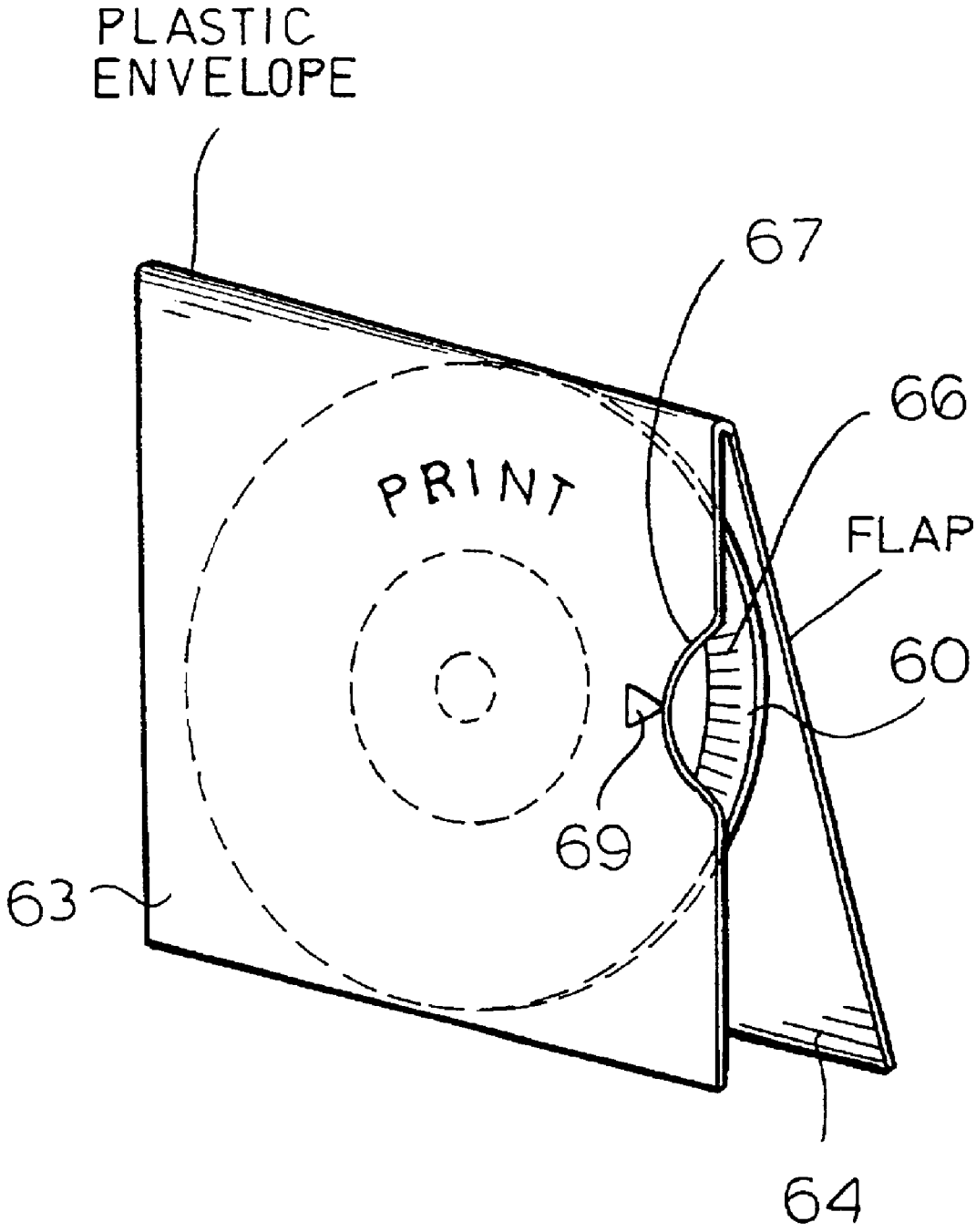
FIG. 7 is a perspective view showing a further embodiment.

In the embodiment of FIG. 7, the disk 60 with its indicia 66 cooperating with indicia 69 on the surface of a plastic envelope 63 is received in that envelope which is formed with a notch 67 through which the disk can be gripped so as to be rotated.

The envelope 63 has a flap 64 which can be swung open to allow the compact disk to be removed and inserted into a computer or player.

When the CD is thus contained in the clear plastic sleeve, there can be printing on the sleeve that correlates with the printing on the CD and the disk can be fully metallized between the hub and the periphery. Alternatively, within the envelope a printed sheet can be received to form part of the support and at the same time provide indicia which is viewed through the disk if the disk has only limited metallization between the hub region and the outer periphery. This configuration is particularly suited for use in mailings.

FIGS. 8 and 9 show an embodiment in which a paper board backing 70 is provided with a blister 71 which encloses the CD 72. A notch 73 is provided through which the outer periphery 74 of the CD 75 can be engaged. The blister and the CD are provided with the correlatable indicia and the CD can be fully metallized between the hub and the periphery. Alternatively, the correlatable which can be provided on the disk and on the backing, in which case the disk is provided with limited metallization and a transparent zone through which the backing indicia can be viewed. This configuration is also highly suitable for use with mailings.

Figure 10:
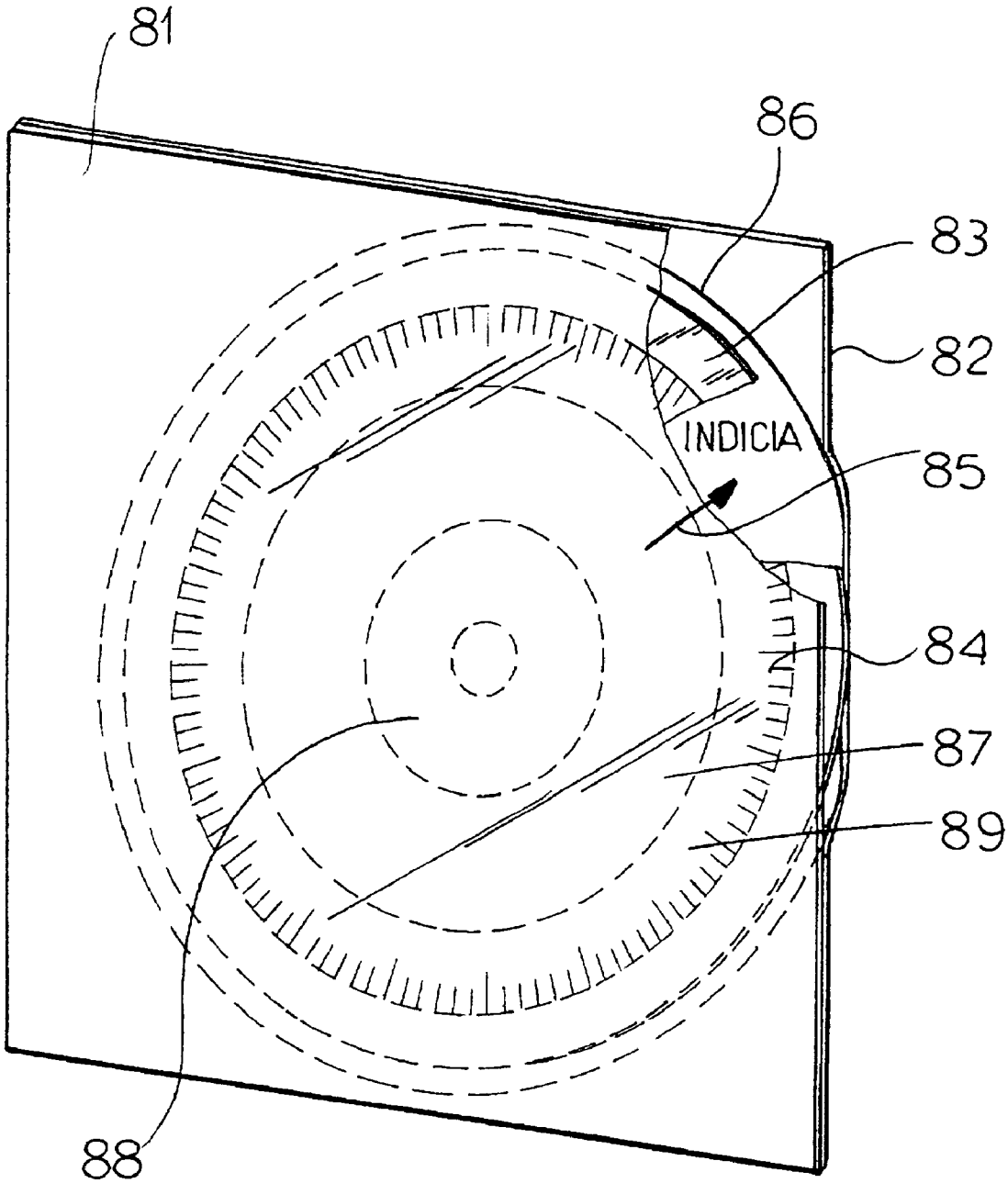
FIG. 10 is a perspective view, partly broken away of still a further embodiment.

FIG. 10 shows an embodiment in which front and back paperboard leaves 81 and 82 form an enclosure for a disk 83 provided with indicia 84 cooperating with indicia 85 on the envelope.

The back member is formed with a recess 86 in which the disk is guided by its outer periphery. In this paperboard construction of the support, there is a recessed region in which the CD is seated and from which the CD can be removed for insertion into a computer or player. As can be seen from FIG. 10 moreover, the CD has metallization limited to the region 87.

Surrounding the hub 88 but leaving a transparent zone 89 through which the indicia 85 on the support is visible.

I claim:

1. A wheel chart comprising:

a support having a surface; and a rigid plastic disk having a hub portion with a central hole and of a compact-disk type at least partially metallized on a face of said disk and rotatable relative to said support, said support and said disk having respective indicia which can be correlated by rotation of the disk relative to said support.

2. The wheel chart defined in claim 1 wherein said support is formed with a pocket receiving said disk and said disk has an edge exposed by said support to enable rotation of said disk.

3. The wheel defined in claim 2 wherein said surface overlies said disk and is formed with at least one window through which indicia on said disk can be viewed.

4. The wheel chart defined in claim 2 wherein said surface underlies said disk and said disk is only partially metallized so that indicia on said surface can be viewed through said disk.

5. The wheel chart defined in claim 2 wherein said disk is guided along its outer periphery by said support for rotation of said disk relative to the support.

6. The wheel chart defined in claim 2 wherein said support has a member engaging through said hole to rotatably support said disk on said support.

7. The wheel chart defined in claim 1 wherein said support is an envelope receiving said disk between leaves of said envelope.

8. The wheel chart defined in claim 1 wherein said support is a rigid plastic disk having a hub provided with a hole, said disks being connected by a member fitted in said holes.

9. The wheel chart defined in claim 1 wherein said metallization can receive machine reproducible information and is separable from said support for reproducing said information.

10. The wheel chart defined in claim 1 wherein said support is paperboard.

11. The wheel chart defined in claim 1 wherein said disk is received in a plastic blister attached to a cardboard backing.

12. The wheel chart defined in claim 1 wherein said support includes a clear plastic sleeve having a notch through which an edge of the disk is exposed for rotating the disk in the sleeve, the sleeve being provided with indicia correlating with indicia on said disk.

13. The wheel chart defined in claim 1 wherein said support has a cavity receiving said disk, said disk having only limited metallization so that indicia on said support can be viewed through said disk.

14. The wheel chart defined in claim 1 wherein said disk is metallized only over part of an area between said hub and an outer periphery of the disk.

15. The wheel chart defined in claim 1 wherein said disk is metallized fully in an area between said hub and an outer periphery of the disk.

* * * * *